US007147566B2

(12) United States Patent
Keating

(10) Patent No.: US 7,147,566 B2
(45) Date of Patent: Dec. 12, 2006

(54) CUE SPORTS TRAINING DEVICE

(76) Inventor: Jeffrey Alan Keating, 1 Aurora Grove, Ocean Reef, Perth (AU) 6027

( * ) Notice: Subject to any disclaimer, the term of this patent is extended or adjusted under 35 U.S.C. 154(b) by 0 days.

(21) Appl. No.: 10/904,334

(22) Filed: Nov. 4, 2004

(65) Prior Publication Data

US 2005/0101395 A1 May 12, 2005

(51) Int. Cl.
*A63F 9/24* (2006.01)
*A63D 15/00* (2006.01)

(52) U.S. Cl. ..... 473/2; 33/286

(58) Field of Classification Search ..... 473/1, 473/2, 17, 220; 434/247; 33/286, 227, 289
See application file for complete search history.

(56) References Cited

U.S. PATENT DOCUMENTS 6,629,897 B1 * 10/2003 Belknap ..... 473/40
6,769,992 B1 * 8/2004 Domulevicz et al. ..... 473/2
6,827,651 B1 * 12/2004 Davis ..... 473/2
2005/0037851 A1 * 2/2005 Evers ..... 473/2

* cited by examiner

*Primary Examiner*—Mitra Aryanpour
(74) *Attorney, Agent, or Firm*—Mark P White

(57) ABSTRACT

A cue sports training device which is adapted in use to be used with a cue sports table such as a billiard, snooker or pool which has a playing surface bounded by an edge and supports a plurality of balls which may rebound from the edge. The device is located near the table. The device having a light source which emits a light beam across the playing surface, the light beam having a principal axis, the device includes an adjustment element which varys the angular displacement of the principal axis of the light beam about an axis perpendicular to the playing surface, the beam positioned such that it will be incident with the balls, wherein in use the device is positioned on the periphery and the angular displacement of the light beam is adjusted to define a desired path for a ball over the playing surface.

2 Claims, 10 Drawing Sheets

CUE SPORTS TRAINING DEVICE

FIELD OF THE INVENTION

The invention relates to a cue sports training device.

Throughout this specification, the term "cue sports" will be taken to include any game which is played on a table having a raised edge and having at least one pocket, in which a cue is used to strike a ball. Such games include billiards, nine ball, pool, snooker, and eight ball.

Throughout this specification, unless the context requires otherwise, the word "comprise" or variations such as "comprises" or "comprising", will be understood to imply the inclusion of a stated integer or group of integers but not the exclusion of any other integer or group of integers.

SUMMARY OF THE INVENTION

According to one aspect the invention resides in a cue sports training device adapted in use to be used with a cue sports table having a playing surface bounded by an edge and in use to support a plurality of balls which may rebound from the edge, in use the device to be located proximate the periphery of the cue sports table, the device having a light source adapted to emit a light beam across the playing surface, the light beam having a principal axis, the device comprising an adjustment element adapted to vary the angular displacement of the principal axis of the light beam about an axis substantially perpendicular to the playing surface, the beam being positioned such that it will be incident with the balls supported on the table, wherein in use the device is positioned on the periphery and the angular displacement of the light beam is adjusted to define a desired path for a ball over the playing surface.

According to a preferred feature of the invention the device comprises an indicator means adapted to indicate the intersection of the axis with the playing surface.

According to a preferred feature of the invention the intersection of the axis with the playing surface is spaced inwardly from the edge.

According to another aspect the invention resides in a cue sports training device adapted in use to be used with a cue sports table having a playing surface bounded by an edge and in use to support a plurality of balls which may rebound from the edge, in use the device to be located proximate the periphery of the cue sports table, the device having a light source adapted to emit a light beam across the playing surface, the light beam having a principal axis, the device comprising an adjustment element adapted to vary the angular displacement of the principal axis of the light beam about an axis substantially perpendicular to the playing surface, the beam being positioned such that it will be incident with the balls supported on the table, wherein in use the device is positioned on the periphery and the angular displacement of the light beam is adjusted to define a desired path for a ball over the playing surface wherein the light source is adapted to emit a first light beam and a second light beam wherein in use the light beams are intended to jointly define the potential path of the bail, the adjustment element adapted to jointly vary the direction of the principal axes of the first and second light beams about a common axis.

According to a preferred feature of the invention the intersection of the common axis with the playing surface is spaced inwardly from the edge. According to a preferred feature of the invention comprises an indicator means adapted to indicate the intersection of the common axis with the playing surface.

According to a preferred feature of the invention the principal axis is substantially parallel with said playing surface.

According to a preferred feature of the invention each light beam is substantially non-divergent.

According to a preferred feature of the invention each light beam is adapted to diverge about its principal axis in a plane which is substantially parallel with the common axis. According to a further preferred feature of the invention, the divergence of each light beam across the table does not exceed 3 mm.

According to a preferred feature of the invention the light beams jointly define an intended angle of incidence of the ball on the edge and an intended angle of rebound of the ball from the edge. According to a preferred feature of the invention the intended angle of incidence is equal and opposite to the intended angle of rebound.

According to a preferred feature of the invention the device comprises a height adjustment element for adjusting the height of the device relative to the playing surface.

According to a preferred feature of the invention the common axis is spaced from the edge by a distance substantially equal to the radius of the ball to define a position along the path at which the ball impacts the edge.

According to a preferred feature of the invention the device further comprises an adjustable spacer element whereby the spacing of the common axis from the edge can be adjusted.

According to a preferred feature of the invention the device further comprises an adjustment element comprises an alignment means to align the angular displacement of the first and second light beams from the playing surface.

According to a preferred feature of the invention each of the first and second light beams may be selectively activated and deactivated.

According to a preferred feature of the invention the first and second light beams are generated from separate light sources. According to a preferred feature of the invention the first and second light beams are supported from rotatable members which are supported to be rotatable about the common axis with the rotatable members being spaced along the axis, a gearing interconnection between the rotatable members to cause the rotatable members to be contra-rotating with resect to each other, the adjustment element comprising a control element linked to one rotatable member and which is adapted to be able to be manipulated to cause rotation of the one rotatable member.

According to a preferred feature of the invention the device comprises a single light source associated with a beam splitter adapted to generate the first and second light beams. According to a preferred feature of the invention the beam splitter comprises a partially reflective first mirror and a second mirror to provide the first and second light beams respectively, the mirrors adapted to be contra-rotatable about the axis.

According to a preferred feature of the invention the device further comprises a means adapted to emit a third light beam coaxial with the common axis, the third light beam to be incident upon the playing surface at the intersection.

According to a preferred feature of the invention the first, second and third light beams are generated from separate light sources.

According to a preferred feature of the invention the device comprises a single light source associated with a beam splitter adapted to generate the first, second and third light beams. According to a preferred feature of the invention the beam splitter comprises partially reflective first and second mirrors to provide the first, second and third light beams, the mirrors adapted to be contra-rotatable about the axis. surface.

The invention will be more fully understood in the light of the following description of several specific embodiments.

BRIEF DESCRIPTION OF THE DRAWINGS

The description is made with reference to the accompanying drawings of which.

DETAILED DESCRIPTION OF SPECIFIC EMBODIMENTS

Figure 1:
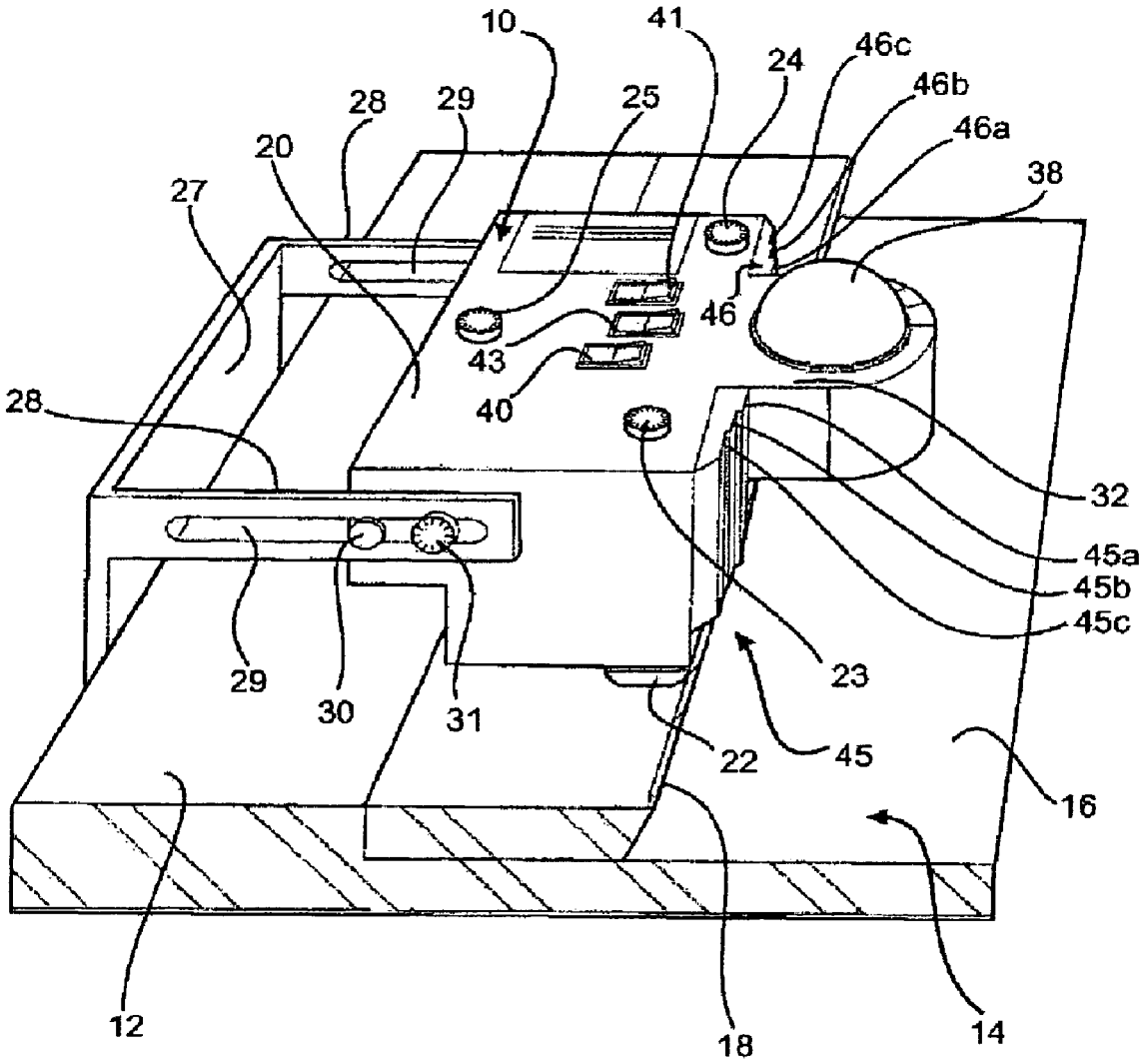
FIG. 1 is a perspective view of a cue sports training device, according to the first embodiment, mounted to the periphery of a cue sports table.
Figure 2:
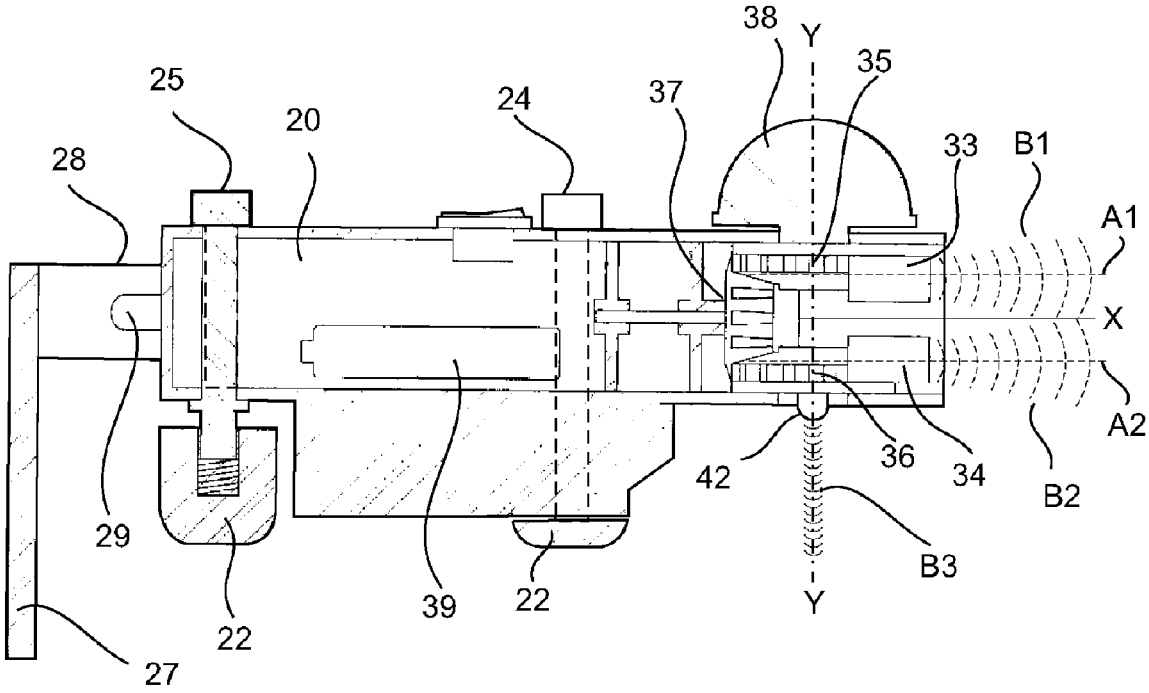
FIG. 2 is a sectional elevation view taken through line A—A of the first embodiment shown in FIG. 1.

The first embodiment as shown at FIGS. 1, 2 and 3 comprises a cue sports training device and is particularly applicable for cue sports tables which are to be used with the games of billiards, snooker and pool. The device 10 is suitable for use with all standard size tables (from 6'×3' to 12'×6') and all standard ball sizes for such games.

FIG. 1 shows the device 10, set up for use, located at the periphery 12 of a cue sports table 14. The table 14 comprises a playing surface 16 bounded by an edge 18 which is typically provided by a cushion. The playing surface 16 supports a plurality of balls (not shown) which are able to rebound from the edge 18.

The device 10 comprises a housing 20 supported from the upper surface of periphery 12 of the table 14 by a set of three feet 22. The feet 22 are adjustable in the direction perpendicular to the upper surface of the periphery, by means of adjustment screws 23, 24 and 25, so that the device 10 can be aligned and positioned with respect to the playing surface 16.

The housing is associated with a locating plate 27 which enables the alignment of the device 10 relative to the edge 18 to be adjusted and the lateral position of the housing across the edge 18. The locating plate 27 is integrally formed with, and supported from, a pair of arms 28 which extend perpendicularly from the locating plate and are affixed to the sides of the housing 20. In this regard the arms 28 are each provided with a slot 29 which is received over a locating dowel 30 and are further engaged by a locking screw 31, both of which are supported from the housing 20. The diameter of the dowel 30 and shank (not shown) of the locking screw 31 are substantially equal to the width of the slots 29 so as to be snugly received by the slots. The locating plate 27 is in use intended to abut the outer edge of the periphery of the table and is adjustable in its spacing from the housing 20 by loosening and subsequent tightening of the locking screws 31 which retain the arms 28 to the housing 20. If desired the locating plate 27 may be removed from the housing 20.

The housing 20 is formed on its forward face with a projecting portion 32 which houses a first and second light source 33 and 34 which are supported to be located on a common plane. The light sources comprise lasers and are each supported from first and second rotatable members 35 and 36 respectively which are each rotatably supported from the housing to be rotatable about a common axis Y—Y which is parallel to the forward face of the housing such that the rotatable members overlie each other. Each rotatable member take the form of gear wheels and are meshingly engaged by a bevel gear 37 which is rotatably supported from the housing for rotation about an axis which is perpendicular to the common axis Y—Y. The upper most rotatable member 35 is associated with a control knob 38 on the upper face of the housing whereby rotation of the control knob caused rotation of the upper rotatable member in one direction around the common axis Y—Y and as result of the bevel gear the rotation of the lower rotatable member in the opposite direction.

The light sources 33 and 34 are powered by a battery 39 which is accommodated in the housing and are controlled by ON/OFF switches 40 and 41 respectively which enable the light sources to be individually activated as required. The light sources 33 and 34 emit light beams $B_1$ and $B_2$ respectively, which each have a principal axis $A_1$, and $A_2$ respectively which perpendicularly intersect the common axis Y—Y. The light sources are associated with a collimation means or the like which limits the diversion of the light beams into a plane which includes the common axis Y—Y.

With rotation of the rotatable members 35 and 36 which support the light sources the beams $B_1$ and $B_2$ are adjustable in their respective directions about the common axis Y—Y to be equally disposed (each by an angle θ) to either side of a central axis X which intersects the common axis Y—Y and is perpendicular to the forward face of the housing 20.

The projecting portion 32 also accommodates a third light source 42 which produces a light beam of light $B_3$ having a principal axis which is coaxial with the common axis Y—Y. The third light source 42 comprises an LED and is associated with a ON/OFF switch 43 to enable it to be selectively activated.

The forward face further comprises a pair of lateral faces 45 and 46 disposed to each side of the projecting portion 32. The lateral faces are formed to have a stepped configuration to provide three pairs of calibrating surfaces 45A, B and C and 46A, b and C which are each parallel to the forward face and are spaced laterally from the central axis X. In addition the calibrating axes of each lateral face having the same spacing from the central axis are co-planar. The spacing of the calibrating faces from the plane which is parallel to the forward face and which includes the common axis Y—Y corresponds to the radii of a standard cue ball and standard game balls (e.g. 27 mm, 25.4 mm and 23.8 mm). The purpose of the pairs of calibrating surfaces is to assist the player in setting the distance between the common axis Y—Y and the edge 18, according to whether the cue ball or a game ball is intended to rebound from the edge 18 as will be explained in further detail below.

In locating the device 10 on a cue sports table for operation the device is located on the upper surface of the periphery and the feet 22 are adjusted on the housing to space the under surface of the projecting portion 32 sufficiently from the playing surface so as to allow the balls to pass thereunder and in order that the principal axes A1 and A2 of the light beams B1 and B2 are substantially parallel to the playing surface. The device 10 is aligned and positioned relative to the edge 18 through adjustment of the spacing of the locating plate 27 from the housing 20. The positioning relative to the edge is achieved by aligning a corresponding pair of calibrating surfaces 45 and 46 with the edge 18 to set the spacing of the common axis Y—Y from the edge to be equal to the radius of the ball.

Figure 3A:
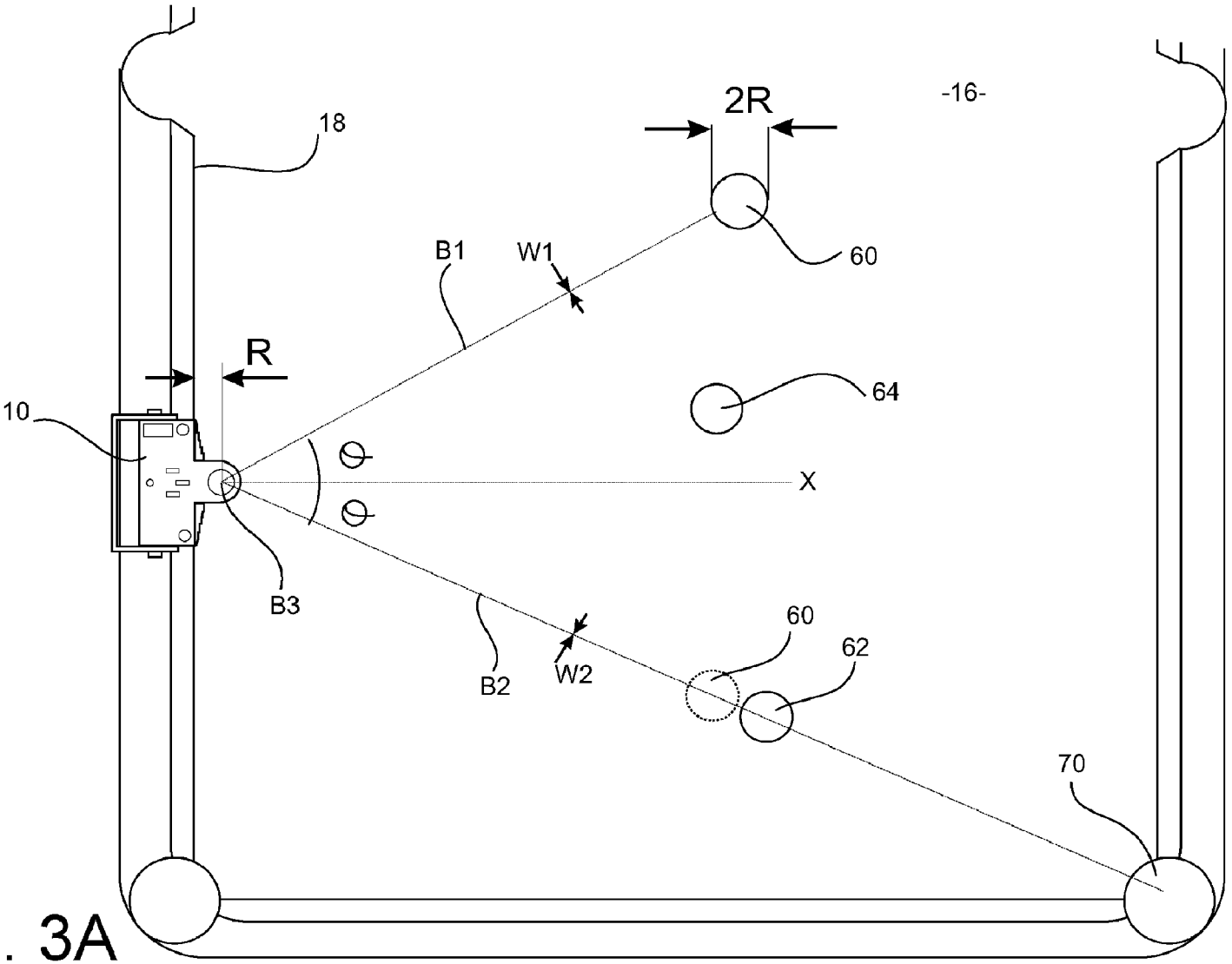
FIG. 3A is a schematic plan view illustrating a particular application of the first embodiment mounted to a cue sports table.

The use of the device 10 according to the first embodiment will now be described with reference to several scenarios as shown at FIGS. 3A, B, C and D of the accompanying drawings.

FIG. 3A depicts a scenario in which it is intended to rebound the cue ball 60 against edge 18 in order to strike game ball 62 therewith and thus to sink that game ball 62 into the corner pocket 70. A direct path between the cue ball 60 and the game ball 62 is obstructed by an opponent's ball 64, thus necessitating a rebound shot. In order to be utilised for this scenario, the device 10 is aligned and positioned with respect to the edge 18, using the appropriate pair of calibrating surfaces for the cue ball, such that the axis Y is located a horizontal distance, equal to the radius R of the cue ball 60, from the edge 18 and the light sources are activated. The device 10 is then slid along the periphery 12 of the table 14 whilst the control knob 38 is adjusted to jointly vary the angle θ of angular displacement from the central axis X until the first light beam $B_1$ is incident upon, and centred on, the cue ball 60, and the second light beam $B_2$ is incident upon, and centred on, the game ball 62 and is in alignment with the pocket 70. The third light source is then activated to indicate the point of intersection between the axis Y and the playing surface 16 which provides a target toward which the cue ball 60 must be struck. Assuming the cue ball 60 is struck accurately, the point of intersection also indicates the position that the centre of the cue ball 60 will occupy when the cue ball 60 impacts the edge 18 and in following the path, defined by first and second light beams $B_1$ and $B_2$, over the playing surface the cue ball should strike game ball 62 and cause it to enter the pocket 70.

Figure 3B:
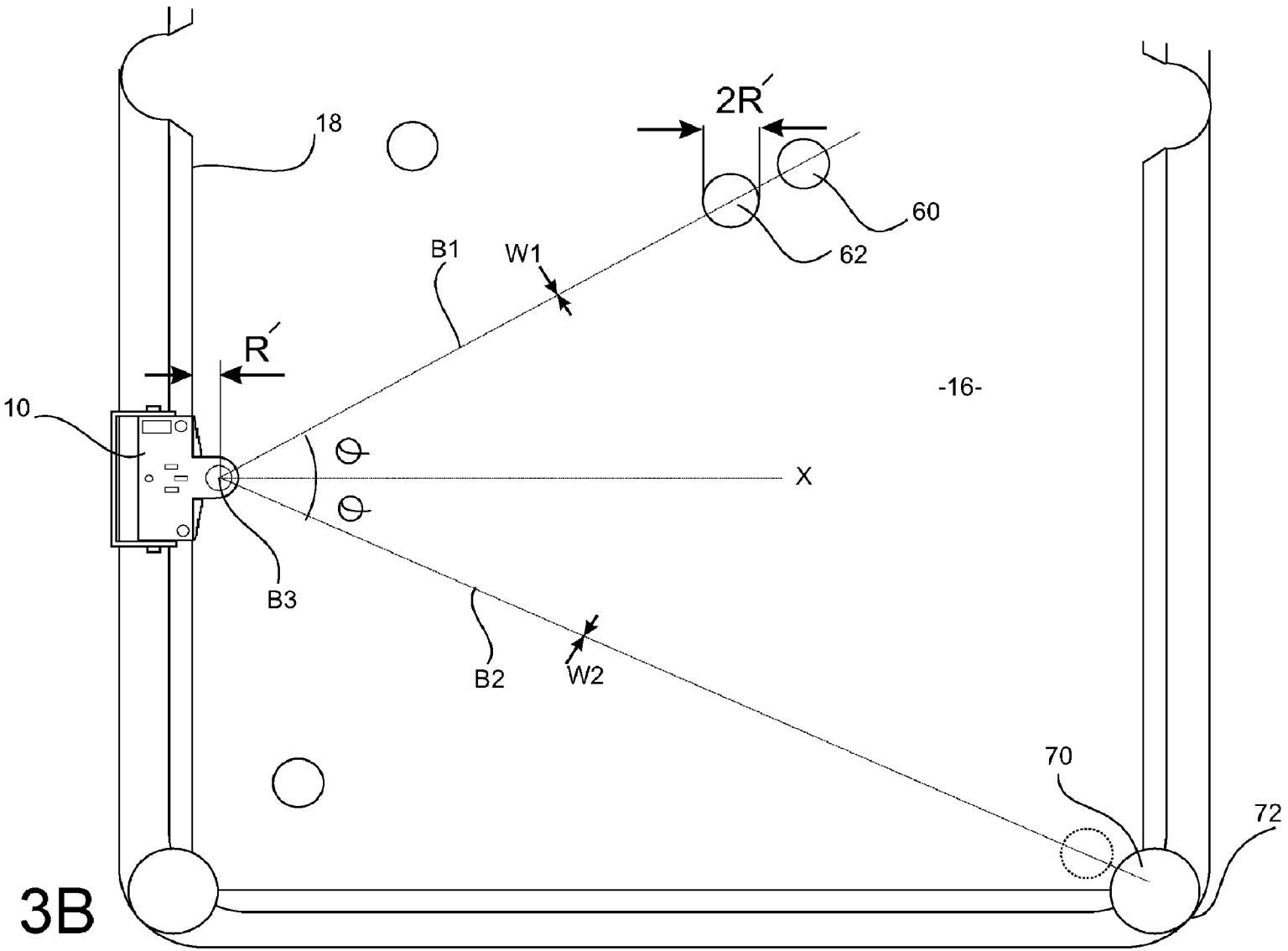
FIG. 3B is a schematic plan view illustrating a further application of the first embodiment mounted to a cue sports table.

An alternative scenario is illustrated at FIG. 3B. In this scenario, it is game ball 62, rather than the cue ball 60, which is intended to be rebounded off the edge 18 to be sunk in corner pocket 70. In order be utilised for this scenario, the device 10 is aligned and positioned with respect to the edge 18 in a manner similar to that described for the previous scenario though using a different pair of calibrating surfaces such that the spacing of the common axis Y—Y from the edge equals the radius R' of the game ball 62. With the first and second light beams $B_1$ and $B_2$ activated, the device 10 is then slid along the periphery 12 of the table 14 whilst the control knob 38 is adjusted to jointly vary the angle θ of angular displacement from the central axis X until the first light beam $B_1$ is incident upon, and centred on, the game ball 62, and the second light beam $B_2$ is incident upon, and centred on, the pocket 70. The third light beam $B_3$ is then utilised to indicate the point of intersection between the axis Y and the playing surface 16, which in this scenario is the target towards which the game ball 62 must be directed after being hit by the cue ball 60 to be sunk in the pocket 70. Assuming the cue ball 60 is hit accurately, the point of intersection also indicates the position that the centre of the game ball 62 will occupy when the game ball 62 impacts the edge 18 in following a path, defined by the first and second light beams $B_1$ and $B_2$, over the playing surface 16 to enter the pocket 70.

Having regard to the scenarios described above, an advantage offered by the embodiment is that, as a result of the identification of the position that the centre of a rebounding ball is to occupy when it impacts the edge 18, there is no error in the determination of the intended path of that ball as defined by beams $B_1$ and $B_2$. The target created on the playing surface 16 by beam $B_3$ provides a true indication of where the ball must be aimed to achieve the desired rebound angle.

Further, the ability to selectively activate and deactivate the first and second light beams ensures that either or both of the beams may be switched off after the device 10 has been set up for a shot, so as to ensure that neither of those beams shines into the player's eyes and distracts the player. This feature also facilitates progressive withdrawal from reliance on the device. Moreover, the device 10 may remain in its position during the player's shot, owing to its ability to be positioned such that the projecting portion 32, as well as any pairs of calibrating surfaces which may overhang the edge 18, are sufficiently clear of the playing surface 16 so as to allow the balls to pass thereunder.

Figure 3C:
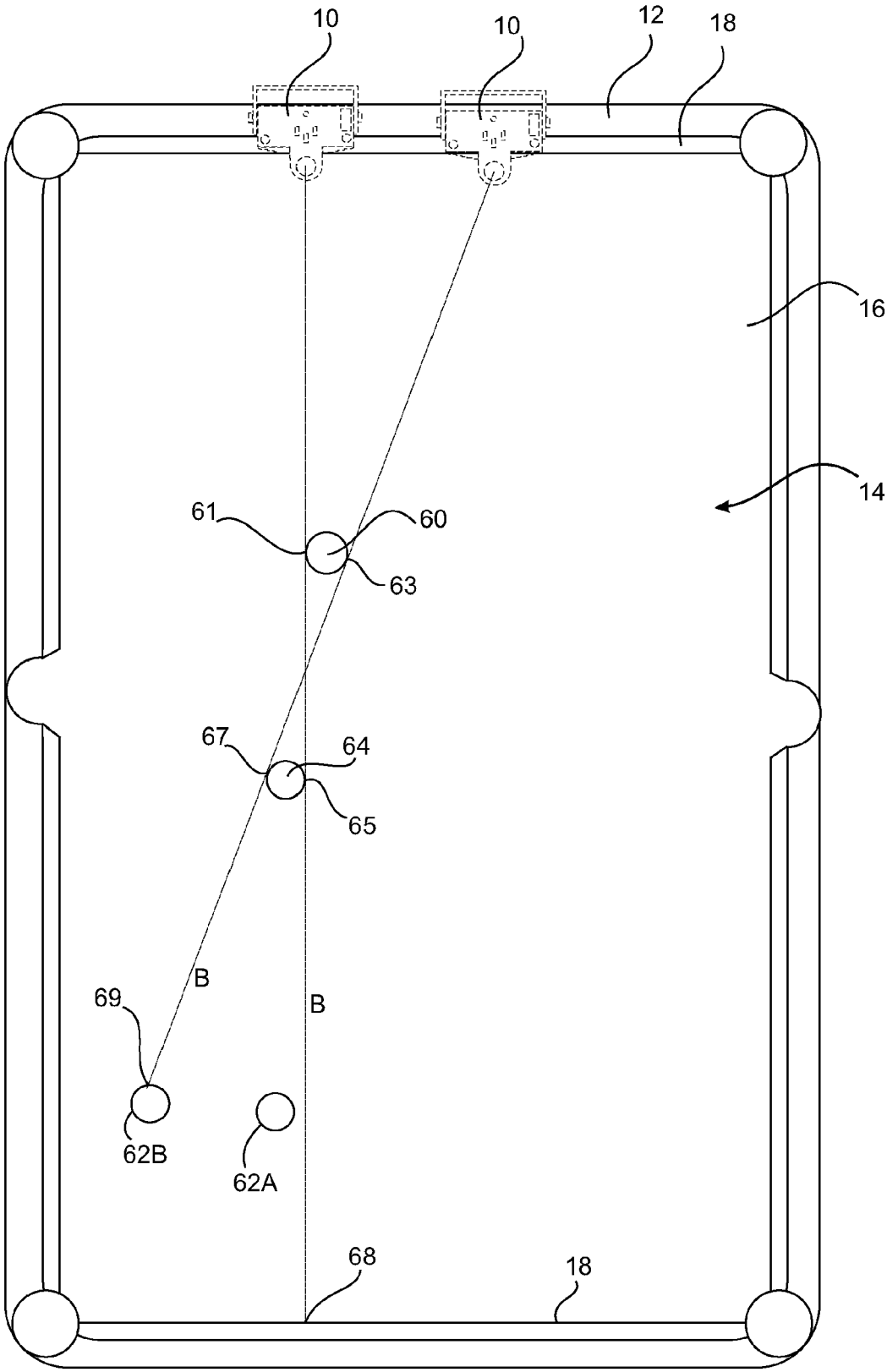
FIG. 3C is a schematic plan view illustrating an alternative application of the first embodiment mounted to a cue sports table.
Figure 3D:
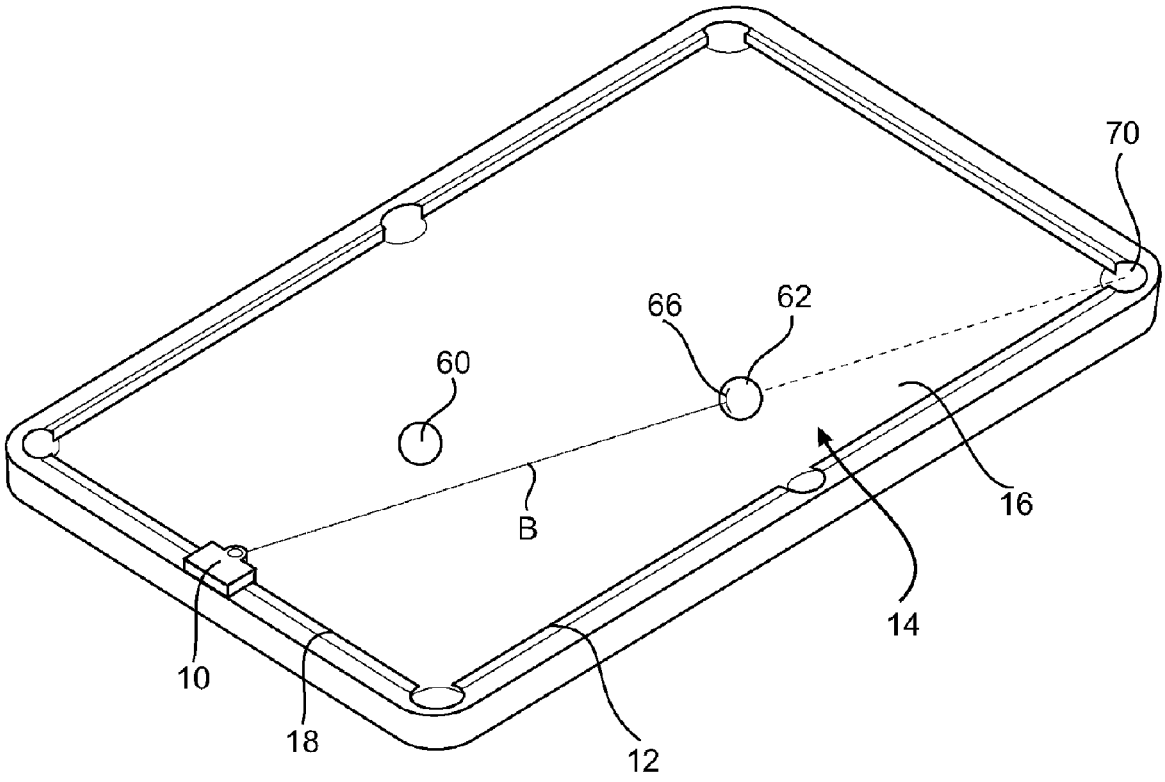
FIG. 3D is a schematic perspective view illustrating a further alternative application of the first embodiment mounted to a cue sports table
Figure 4:
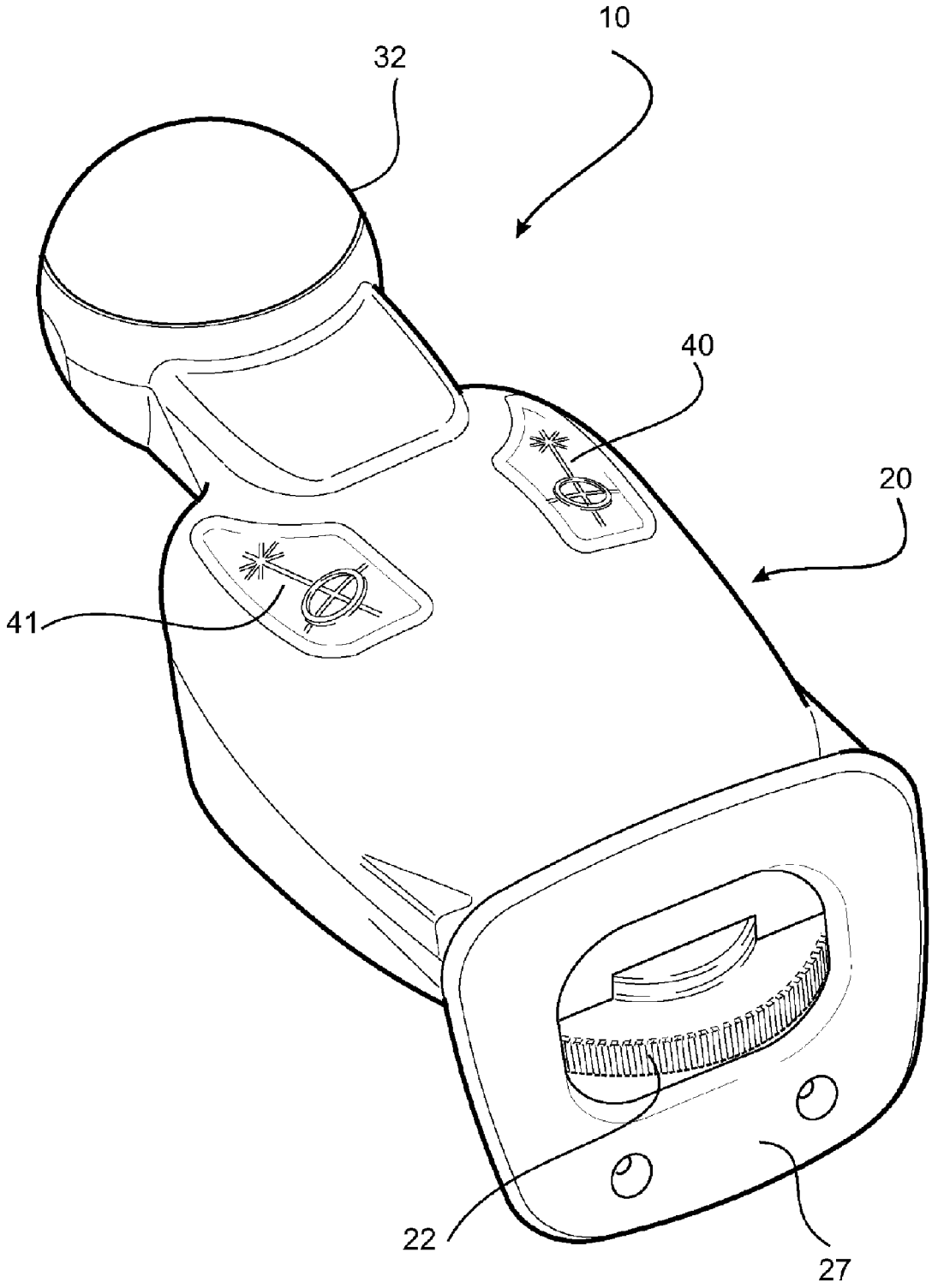
FIG. 4 is a rear isometric view of a cue sports training device according to the second embodiment.
Figure 5:
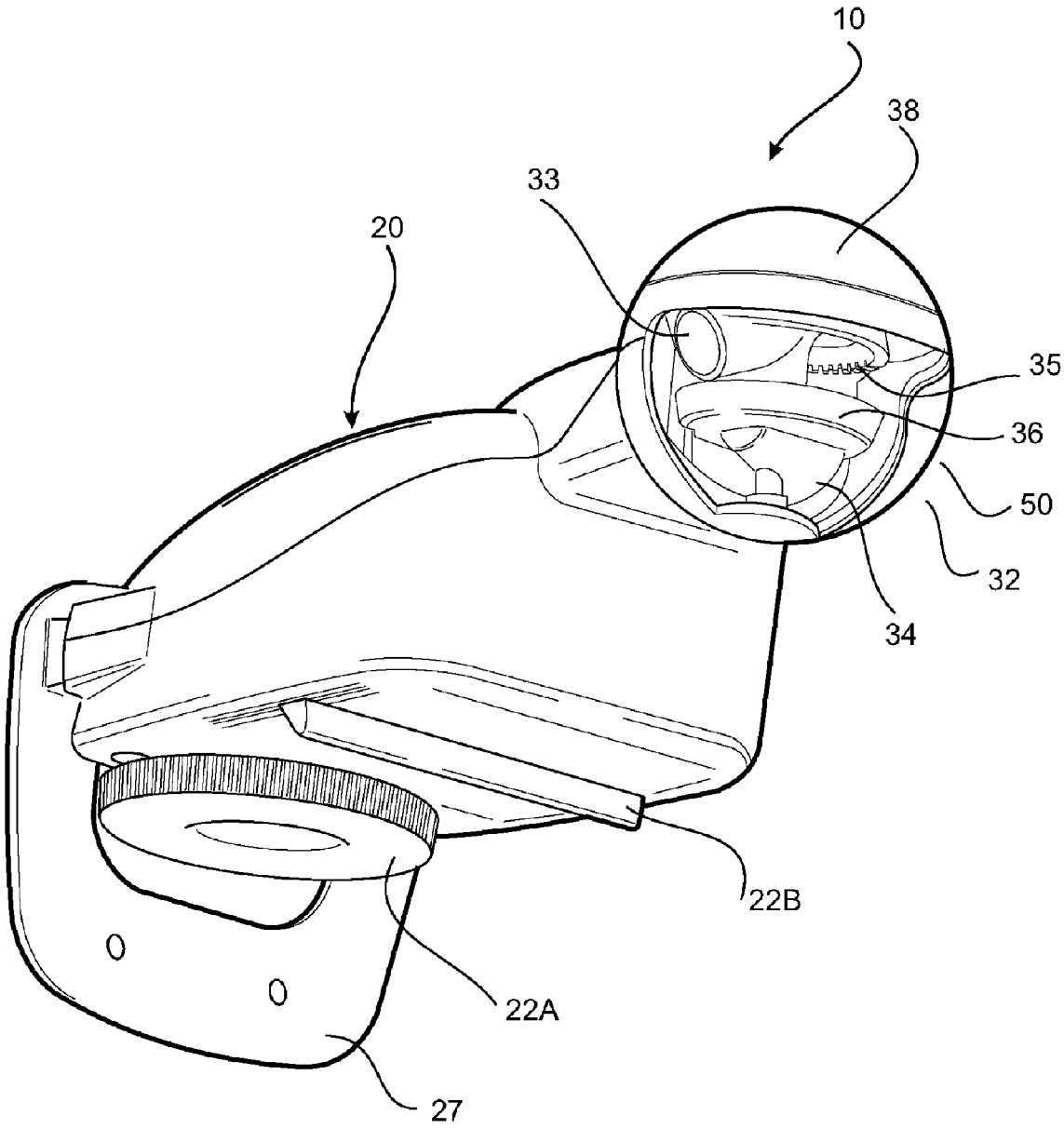
FIG. 5 is a front isometric view of a cue sports training device according to the second embodiment.
Figure 6:
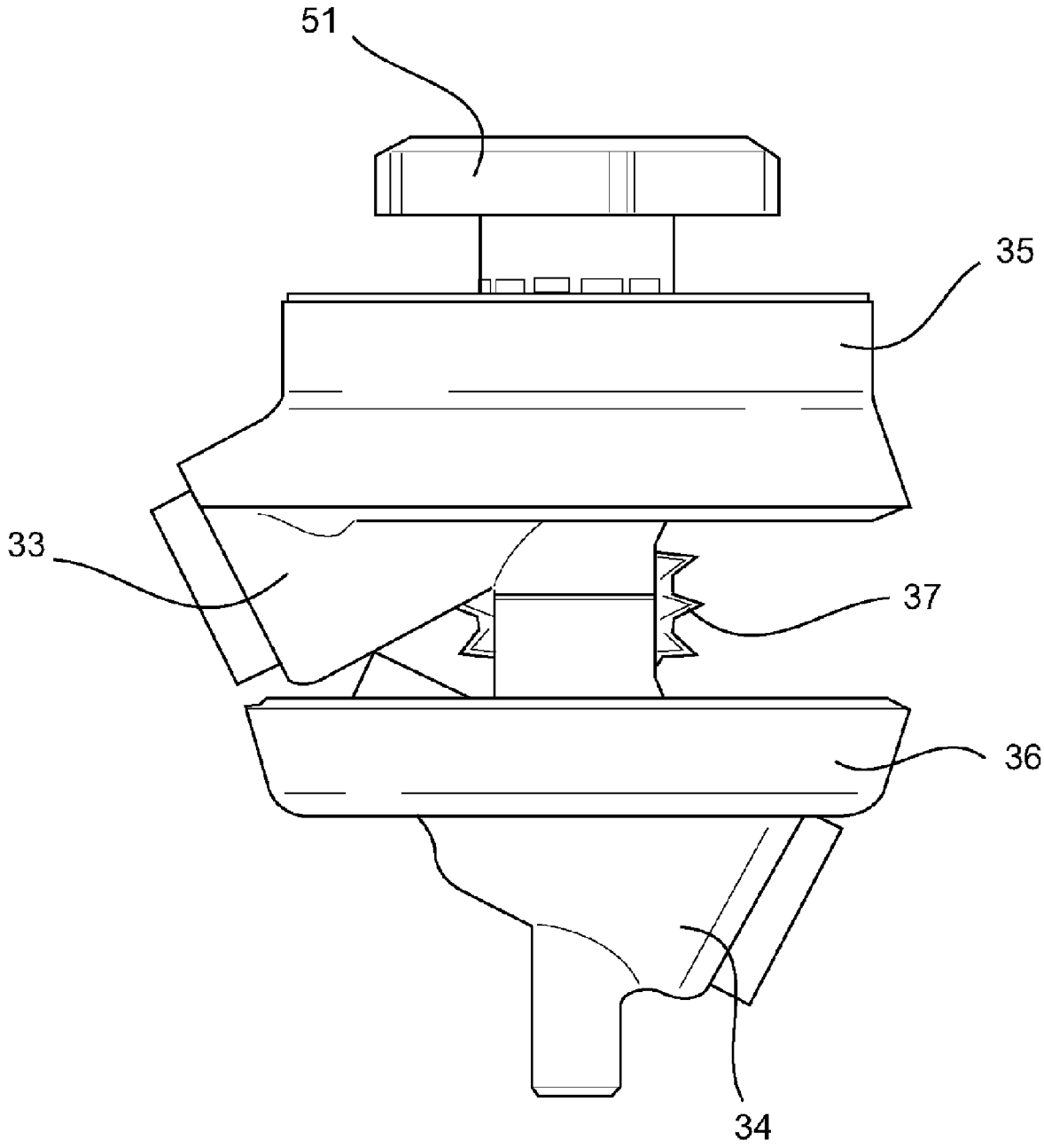
FIG. 6 is a front elevation of the mounting for the first and second light sources of the device according to the second embodiment.

FIG. 3C illustrates a scenario where the device 10 can be used to determine whether an unobstructed path exists for the cue ball 60 to the players game balls 62A and 62B past an opponents game ball 64 (i.e. to establish whether the player is "snookered" by the opponent's ball 64). In this application, only one of the light beams, designated B, is activated. The device 10 is positioned along the periphery 12 of the table 14, whilst the angular orientation of the light beam B is adjusted, such that the beam B only just glances one side 61 of the cue ball 60 and one side 65 of the opponent's ball 64. In the case shown in FIG. 3C this establishes that there is an obstructed straight path between cue ball 60 and one player's ball 62A as a result of the position of the opponent's ball 64 but an unobstructed path between the cue ball and the other players ball 62B FIG. 3D illustrates a scenario where the device 10 can be used to determine where a player's ball 62 should be struck, by the cue ball 60 or another game ball, to effect a desired path of the ball 62 to enable it to enter the pocket 70. The device 10 is positioned along the periphery 12 of the table 14, whilst the angular orientation of beam B is adjusted, such that the beam B is coaxial with an imaginary line extending between the centre of the ball 62 and the centre of the pocket 70, the imaginary line defining the intended path of the ball 62.

The beam so orientated creates a target 66 on the ball 62 defining the point at which the ball 62 must be struck by another ball (in this case the cue ball 60) to send the ball 62 on its intended path to the pocket 70.

The adjustability of the device 10, offered by the feet 22 and the adjustable locating plate 27, enables the device 10 to be used on cue sports tables having differing physical dimensions such as cushion height, cushion width, cushion rail height (relative to the cushion), cushion rail width, pocket opening size and playing surface dimensions.

The second embodiment as shown at FIGS. 4, 5, 6 and 7 is generally similar to the first embodiment and corresponding components of the each of the embodiment as shown in the drawings have been given corresponding reference numerals.

In the case of the second embodiment the location plate 27 is supported from the housing by a pair of arms which are slidably supported from the housing to enable the spacing of the locating plate relative to the housing 20 to be varied, in order to enable the device to be adjusted to the dimensions of the table and to located. The slidable engagement of the arms in the housing is such that the arms will be retained at a position and a force will need to be positively applied to between the locating plate and the housing to cause relative displacement between the locating plate and the housing. The retention can be affected by providing frictional engagement between the arms and the housing and/or intergaging toothed formations between the arms and the housing.

In addition the second embodiment does not have the third light source or the calibration surfaces of the first embodiment.

Figure 7:
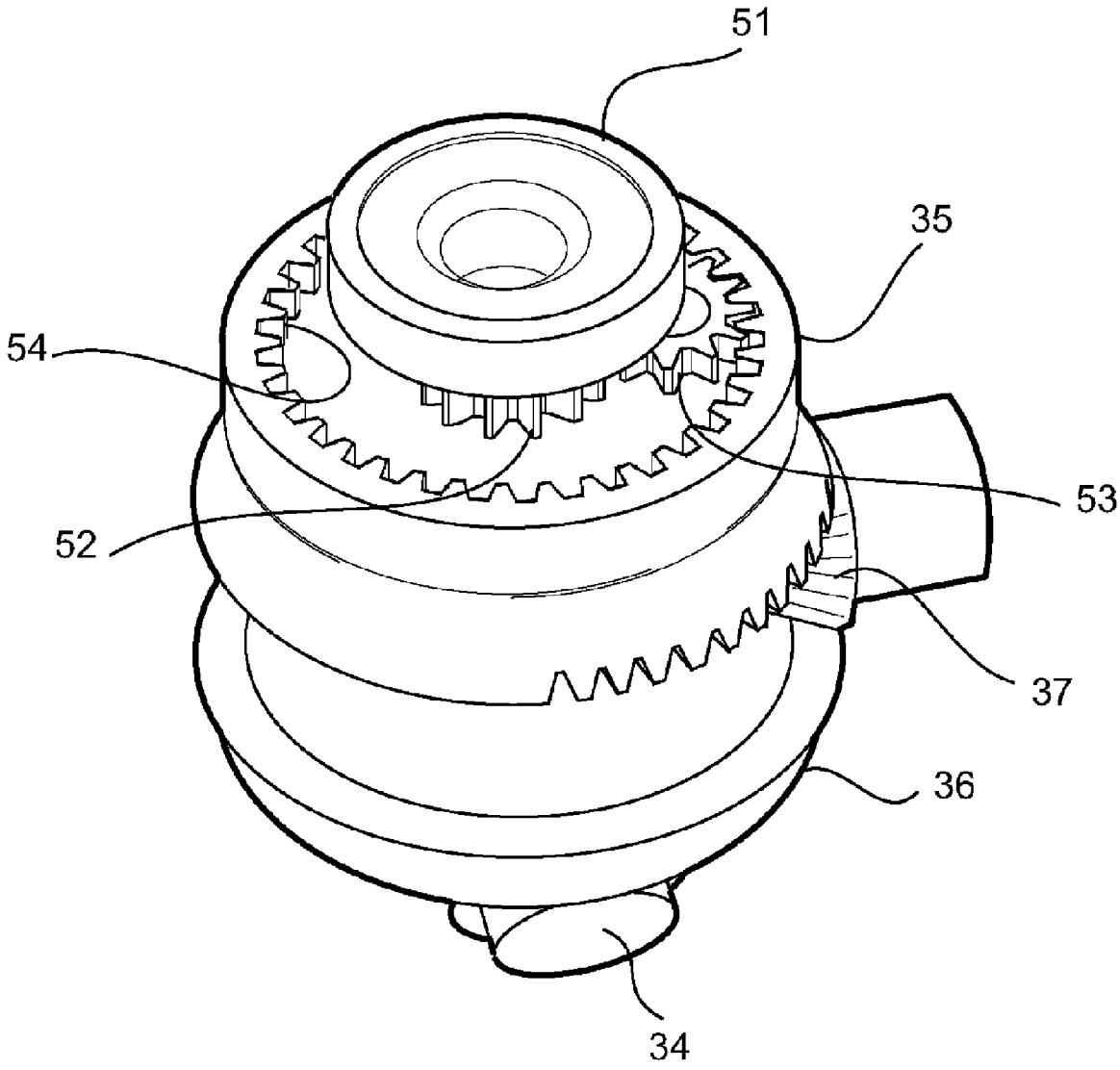
FIG. 7 is an upper isometric view of the mounting for the first and second light sources of the device according to the second embodiment.

The housing 20 of the second embodiment has a forward portion which has a generally spherical configuration where the front face 50 of the lower portion is transparent and the upper portion is rotatable relative to the remainder of the forward portion and defines the control knob 38. The interior of the forward portion accommodates the first and second light sources 33 and 34 which are controlled by the switches 40 and 41 and which are positioned to direct their light beams through the transparent wall of the lower portion of the forward portion. The rotatable members 35 and 36 which support the light sources are interconnected through the intermediate bevel gear 37. In addition the control knob is linked to the upper rotatable member 35 through a drive wheel 51 which is engaged with the inner face of the knob and as shown at FIG. 7 and is formed at its lower end with a pinion gear 52 which is associated with an intermediate gear wheel 53 which connects the pinion gear 52 with an inner gear 54 formed around the periphery of the upper rotatable member 35.

The feet 22 of the second embodiment comprise an adjustable foot 22A which is located rearward and is formed as a knurled wheel having a portion extending beyond the rear face of the housing. Rotation of the adjustable foot will vary its displacement from the housing and to effect the rotation the portion of the wheel which extends beyond the rear face of the housing is manipulated. The feet further comprise a fixed foot 22B which is spaced forwardly from the adjustable foot 22A. The fixed foot 22B is formed as a rib which extends transversely across the underneath of the housing. The relationship between the feet is such that the adjustment of the adjustable foot 22A causes the housing to pivot on the fixed foot 22B and cause angular displacement of the light beams B1 and B2.

In a further alternative embodiment the device may comprise only a single light source disposed in an upper position in the projecting portion 38 and adapted to emit a single light beam and the device further comprises a beam splitter adapted to split the single light beam into the first, second and third light beams of similar intensity. Specifically, the beam splitter may comprise a first mirror and a second mirror which are only partially reflective where each is contrarotatable about axis Y, to provide the first and second light beams respectively. The first mirror would reflect a portion of the emitted light which is incident on its surface to provide the first light beam. The remaining portion of the emitted light would pass through the first mirror to be incident upon the surface of the second mirror, which would reflect a further portion of the remaining portion of the emitted light to provide the second light beam. The remnant portion of the emitted light, which passes through the second mirror, would continue to the playing surface 16 and would constitute the third light beam.

The second embodiment is used in a similar manner as has been described in regard to the first embodiment.

Alternative scenarios to those described above are envisaged where it may be desirable to alter the direction of the central axis X such that it is not perpendicular to the edge 18, such as in a situation where the player wishes to practise a "spinning rebound shot". To this end, there may be provided an embodiment comprising a biasing means to vary the direction of axis X such that the angles that the first and second light beams $B_1$ and $B_2$ make with the edge 18 are different, (i.e. the intended angle of incidence of the rebounding ball differs from the intended angle of rebound of that ball).

In an alternative embodiment, the first and second light sources 35 and 36 may be LEDs.

In a further alternative embodiment the device may comprise only a single light source disposed in an upper position in the projecting portion 38 and adapted to emit a single light beam and the device further comprises a beam splitter adapted to split the single light beam into the first, second and third light beams of similar intensity. Specifically, the beam splitter may comprise a first mirror and a second mirror which are only partially reflective where each is contra-rotatable about axis Y, to provide the first and second light beams respectively. The first mirror would reflect a portion of the emitted light which is incident on its surface to provide the first light beam. The remaining portion of the emitted light would pass through the first mirror to be incident upon the surface of the second mirror, which would reflect a further portion of the remaining portion of the emitted light to provide the second light beam. The remnant portion of the emitted light, which passes through the second mirror, would continue to the playing surface 16 and would constitute the third light beam.

In the first embodiment, the gearing ratio between the control knob 38 and the rotatable members is 1:1. Alternative embodiments are possible wherein an intermediate gear is disposed between the control knob 26 and the rotatable member 54 to give rise to a different gearing ratio.

Furthermore, embodiments are envisaged which comprise an adjustment means, such as a control knob or control lever, that are remote from the device.

In another alternative embodiment, the feet 22 may be provided with wheels to facilitate repositioning of the apparatus along the periphery 12 of the table 14.

According to alternative embodiments of the invention, the number of pairs of calibration surfaces can be varied.

It should be appreciated that the scope of the present invention need not be limited to the particular scope of the embodiments described above.

What is claimed is:

1. A cue sports training device adapted in use to be used with a cue sports table having a playing surface bounded by an edge and in use to support a plurality of balls which may rebound from the edge, the device comprising:

(a) a light source adapted to emit a first and a second light beam across the playing surface, the light beams each having a principal axis;

(b) an adjustment element adapted to jointly vary the angular displacement of the principal axes of the light beams about a common axis which is substantially perpendicular to the playing surface, wherein an intersection of the common axis with the playing surface is spaced inwardly from the edge by a distance substantially equal to the radius of the ball so as to define a position along the path at which the ball impacts the edge, in use the beams being positioned relative to the playing surface such that they would be incident with the balls supported on the table which may be located in their path; and (c) an adjustable spacer element, whereby the spacing of the common axis from the edge can be adjusted, wherein in use the device is positioned proximate to the edge of the cue sports table, and the angular displacement of the light beams can be adjusted by the adjustment element to define a desired path for a ball over the playing surface.

2. A cue sports training device adapted in use to be used with a cue sports table having a playing surface bounded by an edge and in use to support a plurality of balls which may rebound from the edge, the device comprising:

(a) a light source adapted to emit a first and a second light beam, each generated from a separate light, across the playing surface, the light beams each having a principal axis;

(b) an adjustment element adapted to jointly vary the angular displacement of the principal axes of the light beams about a common axis which is substantially perpendicular to the playing surface, in use the beams being positioned relative to the playing surface such that they would be incident with the balls supported on the table which may be located in their path, wherein in use the device is proximate the edge of the cue sports table, and wherein the angular displacement of the light beams can be adjusted by the adjustment element to define a desired path for a ball over the playing surface, and wherein, the first and second light sources are supported from rotatable members which are supported to be rotatable about the common axis with the rotatable members being spaced along the axis, a gearing interconnection between the rotatable members to cause the rotatable members to be contra-rotating with respect to each other, the adjustment element comprising a control element linked to one rotatable member and which is adapted to be able to be manipulated to cause rotation of the one rotatable member.

* * * * *